US005895328A

United States Patent [19]

Pahio

[11] Patent Number: 5,895,328

[45] Date of Patent: Apr. 20, 1999

[54] GOLF SWING TRAINING APPARATUS

[76] Inventor: Pete Pahio, 8013 Scottsdale Dr., Sacramento, Calif. 95828

[21] Appl. No.: 09/130,919

[22] Filed: Aug. 7, 1998

Related U.S. Application Data

[63] Continuation-in-part of application No. 08/975,240, Nov. 21, 1997, abandoned.

[51] Int. Cl.[6] ..... A63B 69/36

[52] U.S. Cl. ..... 473/224; 473/220

[58] Field of Search ..... 473/220, 221, 473/223, 224

[56] References Cited

U.S. PATENT DOCUMENTS

| | | | |
|---|---|---|---|
| 2,787,470 | 4/1957 | Barrus et al. . | |
| 3,106,403 | 10/1963 | Kirkman . | |
| 3,226,704 | 12/1965 | Petrash . | |
| 4,515,368 | 5/1985 | Petitjean . | |
| 4,819,942 | 4/1989 | Lee et al. . | |
| 4,852,875 | 8/1989 | McLennan et al. . | |
| 5,277,428 | 1/1994 | Goodwin et al. . | |
| 5,435,561 | 7/1995 | Conley . | |
| 5,441,269 | 8/1995 | Henwood . | |
| 5,492,329 | 2/1996 | Kronin | 473/223 |

*Primary Examiner*—George J. Marlo
*Attorney, Agent, or Firm*—James M. Ritchey

[57] ABSTRACT

A swing training apparatus for sensing centrifugal force created from a swing of a handheld sport implement and producing a signal for a predetermined level of centrifugal force. The apparatus comprises a housing holding a battery affixed to a sliding member that is slidably positioned within the housing. An adjustable force signal mechanism is electrically connected to the battery. A spring holds the sliding member and battery in a signal nonactuating position within said housing until sufficient centrifugal force, created by the swinging sport implement, slides the sliding member within the housing into a signal actuating position, thereby actuating said signal mechanism to produce a signal.

7 Claims, 5 Drawing Sheets

GOLF SWING TRAINING APPARATUS

CROSS-REFERENCE TO RELATED APPLICATIONS

This is a continuation-in-part of application Ser. No. 08/975,240 filed on Nov. 21, 1997, now abandonded.

BACKGROUND OF THE INVENTION

1. Field of the Invention

A swing training apparatus for a handheld sport implement is provided. More specifically, a swing training apparatus is disclosed that includes an electronic assembly that emits at least an audible signal when actuated by the shifting of the power supply. The power supply, also acting as a mass, moves in response to the centrifugal force from the swing of the sport implement, such as a golf club. The force required to move the power supply may be manipulated by adjustment of a biasing means that applies force to the power supply in the opposite direction of the centrifugal force. The apparatus is designed to train the user to develop a controlled and consistent swing. By producing, at a minimum, an auditory signal, the apparatus will be especially useful to the visually impaired golfer.

2. Description of the Background Art

Golf is a game of precision and reproducibility. One of the most critical aspects of playing golf is developing a smooth, controlled and consistent golf swing. This desired golf swing is just as important for an experienced golfer as for a novice golfer.

Several apparatuses have been designed that emit a signal when a desired golf swing is achieved by the golfer. Most of these apparatuses use a stationary power supply that actuates a signaling device when a separate or secondary mass or weight moves to a contact point and completes the circuit. Generally, these apparatuses noticeably increase the weight of the golf club, especially when mounted proximate to the club head, thereby possibly altering the golfer's normal swing. By using the power supply as the actuating movable mass, thus eliminating the additional or secondary separate mass, the total weight of the apparatus can be minimized so that use of the apparatus is virtually undetectable when mounted on the shaft of the golf club, even when mounted proximate to the club head. None of the prior apparatuses has previously been devised that utilizes a movable or shiftable power supply as the mass that actuates the signaling device.

U.S. Pat. No. 4,515,368 introduces a golf club swing training device that emits an audible signal which is generated by the compression of a spring by a rod or a plunger. The power supply is fixedly positioned and remains stationary in a separate compartment from that of the rod or plunger that actuated the audible signal.

Disclosed in U.S. Pat. No. 3,106,403 is a club momentum indicator that utilizes a mechanical system that produces an auditory signal and an electrical system that produces a visual signal. The mechanical and the electrical systems are activated by the release of a hammer, wherein the hammer moves from the centrifugal force of the golf swing. Upon release, the hammer causes a clicking sound and closes an electrical circuit to illuminate a light. The hammer must be reset after each release. The power supply for the electrical system remains in a fixed or stationary position.

U.S. Pat. No. 4,852,875 presents a racquet swing training apparatus. This invention presents an electronic system that is actuated by a biased slug, wherein centripetal force urges the slug toward a contact point to complete an electrical circuit that causes an auditory signal to be generated. An adjustment means changes the position of the contact. The power supply is held in place by an adhesive or other securing material and remains stationary during operation of the device.

Revealed in U.S. Pat. No. 4,819,942 is a golf swing indicator in an annular housing with an inner tube-like sleeve that mounts on the golf club by passing the shaft through a central passage of the sleeve. The indicator is illuminated by centrifugal closure of a switch arm that makes contact with a fixed or stationary power supply.

A golf club accelerometer is revealed in U.S. Pat. No. 3,226,704. This apparatus is actuated by a sudden stop or jerking motion during the swing. A weight, mounted on a pivoting arm, shifts when acceleration force develops on the weight due to an erratic swing and touches a contact point to complete an electrical circuit, thereby causing an auditory signal. The power supply is stationarily mounted above the shifting weight.

U.S. Pat. No. 5,435,561 presents an electronic putting trainer that is positioned within the grip on the shaft of a putting club. This invention detects rotation inertia by movement of a weight, not being the power supply, attached to the free end of an elongated arm; the other end of the elongated arm is fixed to allow the arm to pivot. When the weight moves and touches a contact point, the circuit is complete and current flows from a stationary power supply to activate an alarm signal.

A golf club swing training device is disclosed in U.S. Pat. No. 5,277,428 for monitoring proper acceleration of a putter. A spring flexes on a pivot point, thereby moving a mass that is detected by use of infrared radiation. Upon detection of the mass, an auditory and visual feedback is generated, the visual feedback being powered by a stationary power supply.

Presented in U.S. Pat. No. 5,441,269 is a putting stroke training device that mounts to the putter head. This invention detects undesired X-axis, Y-axis and Z-axis movement by individual respective electronic sensors. Activation of the sensors causes an alarm that is electronically energized by a secured or stationary power supply.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

An object of the present invention is to provide an easily installable and easily removable training apparatus that attaches to a handheld sport implement and is designed to assist the user in developing a more controlled and consistent swing.

Another object of the present invention is to furnish a golf swing training apparatus that attaches to the shaft of any golf club, proximate the golf club head, which is virtually undetectable due to the light weight of the apparatus.

A further object of the present invention is to supply a golf swing training apparatus that may be used to aid the novice as well as the experienced golfer to develop a consistent back and forward swing.

Still another object of the present invention is to disclose a golf swing training apparatus that emits a signal when the desired golf swing is achieved that will aid the golfer, including a physically as well as visually impaired golfer, to develop a controlled and constant swing.

Yet a further object of the present invention is to describe a golf swing apparatus that emits a signal to inform the user of the desired golf swing speed, wherein the signal is actuated by a power source that moves to a new position in response to a predetermined centrifugal force from the golf swing.

Disclosed is a golf swing training apparatus, actuated by centrifugal force of a golf swing, for attachment to the shaft of a golf club, the apparatus comprises a housing for accommodating a movably mounted or "kinetic" power source, a signaling device, and a circuitry means for completing a circuit between the movably mounted or kinetic power source and the signaling device. In response to centrifugal force of the golf swing, the power source moves (the term "kinetic" refers to the movement of the actual power source or supply during a swing process) from an open circuit nonactuating position to a closed circuit actuating position. When the power source comes to rest and is positioned in the closed circuit actuating position, the signaling device emits a signal. A continuous signal, at least including an audible signal, informs the user that the swing is constant and consistent. An adjustable means is included for manipulating the desired centrifugal force needed, depending upon the golf club or the swing speed, to move or relocate the power source to the actuating position.

More specifically, the subject apparatus comprises a housing, a power source, a sliding member affixed to the power means and slidably positioned within the housing, biasing means for holding the sliding member in a signal nonactuating position within the housing, and signal means coupled to the sliding member. The centrifugal force created by the swinging sport implement slides the sliding member within the housing thereby actuating the signal means to produce a signal. Adjustable force means are provided that regulates the amount of centrifugal force necessary to produce a signal. Preferably, the adjustable force means comprises an electrically conductive screw adjustable mounted in the housing and an electrically conductive bases plate contacting the electrically conductive screw. The sliding member usually comprises a panel sized to fit and to slide within the housing. Further, generally the power means comprises a battery secured to the sliding member.

In particular, the apparatus often comprises a housing having an interior compartment, a sliding panel slidably positioned within the interior compartment of the housing, a battery having first and second terminals and secured to the sliding panel, a signaling means having first and second terminals and wired by the first signaling means terminal to the first battery terminal, an electrically conductive screw adjustable mounted in the housing, an electrically conductive base plate contacting the electrically conductive screw, and an electrically conductive spring wired to the signaling means second terminal and contacting the electrically conductive base plate. The spring maintains a centrifugal force sensitive separation between the second battery terminal and the electrically conductive screw, whereby when the golf swing produces the sufficient centrifugal force the second battery terminal contacts the electrically conductive screw thereby forming a complete circuit and activating the signaling means.

Other objects, advantages, and novel features of the present invention will become apparent from the detailed description that follows, when considered in conjunction with the associated drawings.

DESCRIPTION OF THE PREFERRED EMBODIMENT

Figure 1:
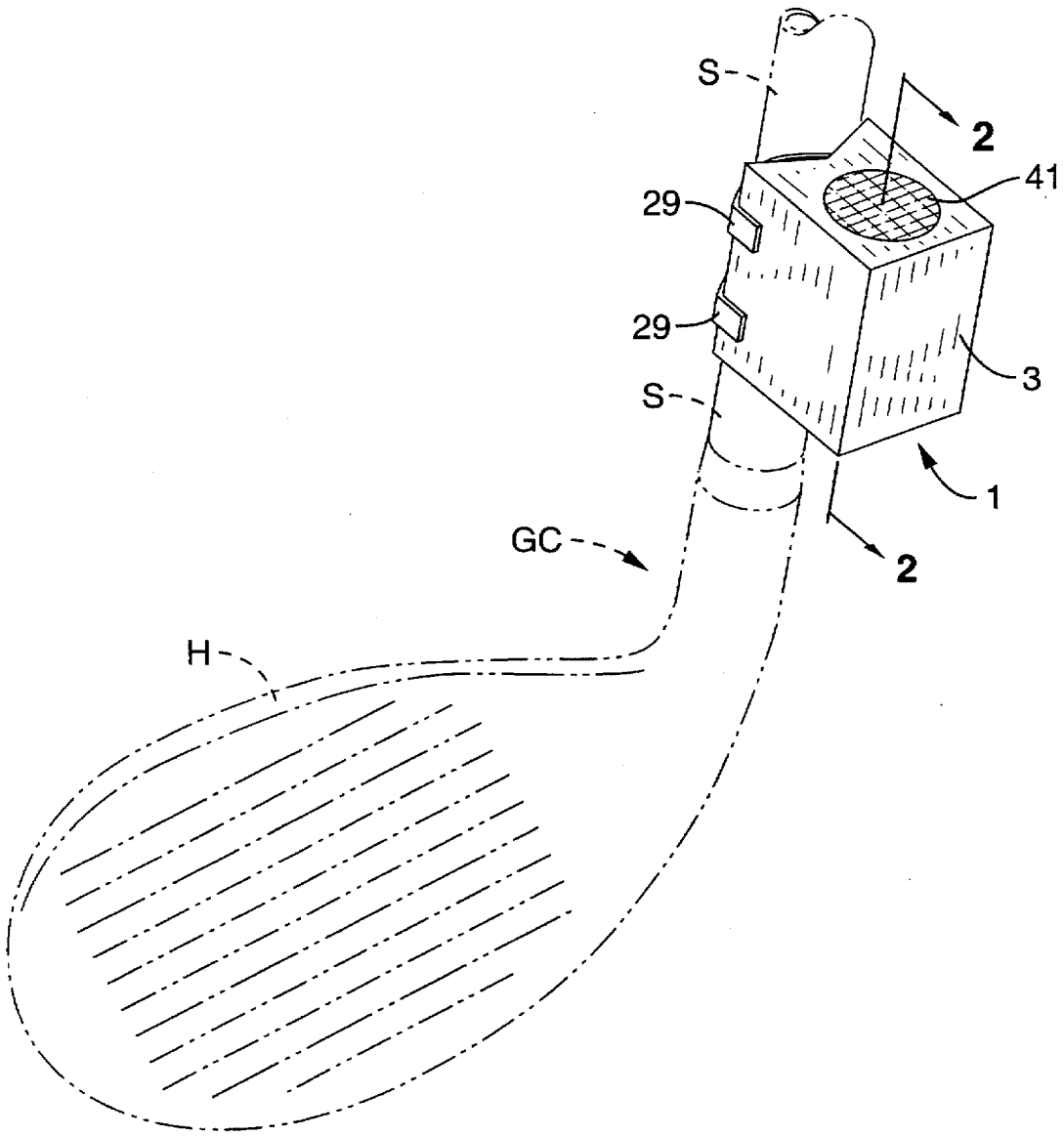
FIG. 1 is a perspective, cut away view of the apparatus attached to a golf club, proximate to the club head.
Figure 2A:
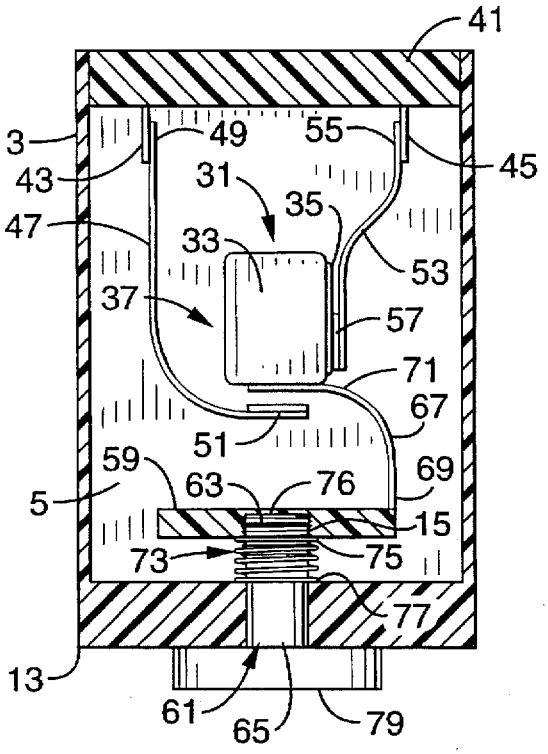
FIG. 2*a* is an enlarged front side sectional view taken along line 2—2 of the apparatus, as shown in FIG. 1, showing the inner compartment of the apparatus with the movable or kinetic power source in the nonactuating position.
Figure 2B:
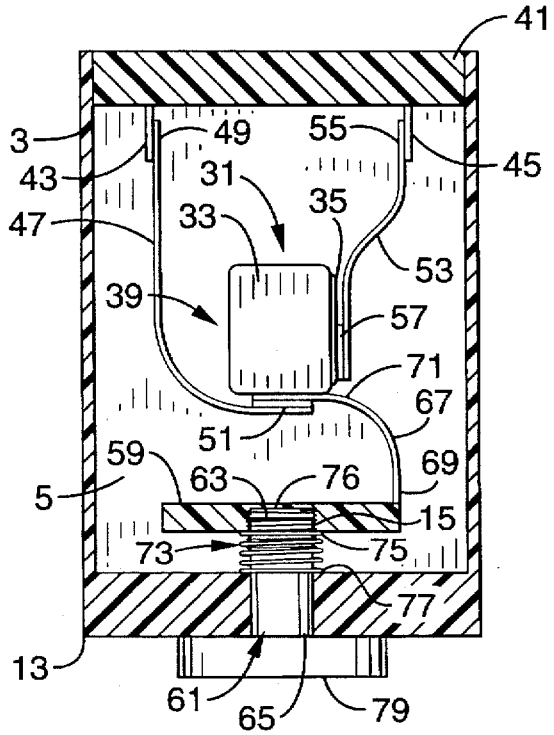
FIG. 2*b* is an enlarged front side sectional view taken along line 2—2 of the apparatus, as shown in FIG. 1, showing the inner compartment of the apparatus with the movable or kinetic power source in the actuating position.
Figure 3:
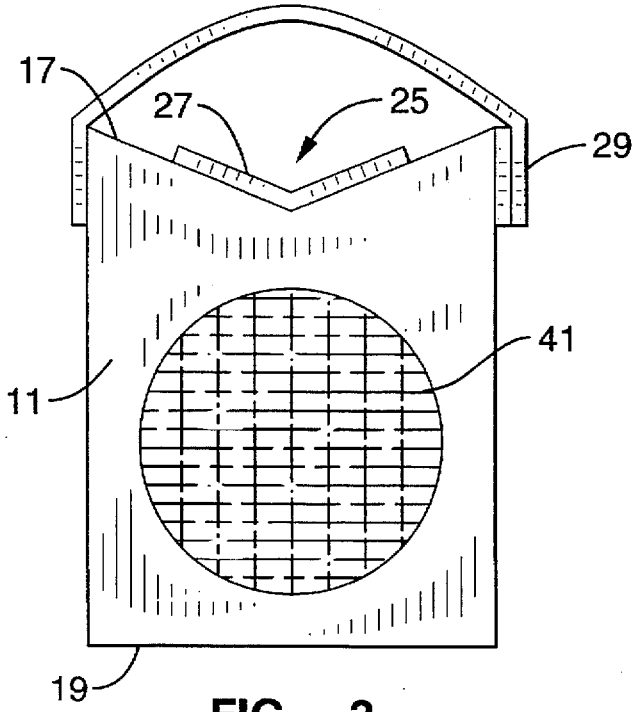
FIG. 3 is an enlarged top side view of the apparatus.

Referring now to FIGS. 1–6, there are shown preferred embodiments of a swing training apparatus for a handheld sport implement. Usually, but not exclusively, the apparatus is associated with the sport implement for golf, or a golf club. However, the apparatus may be appropriately used for other sport implements having a shaft, a head, and a grip, such as, for example, a tennis racket. For exemplary purposes, the subject invention will be described in terms of a golf swing training apparatus. Thus, comprising the subject invention is a golf swing training apparatus 1 or 101 for sensing centrifugal force created from a golf swing. For exemplary purposes only a first embodiment (shown specifically in FIGS. 1–4) will be detailed initially. With the first embodiment of the golf swing training apparatus 1 a predetermined centrifugal force moves, transports, or shifts the power supply 31, thereby actuating a signaling device 41 to produce an audible signal.

Specifically, the first embodiment of the subject invention or apparatus 1 comprises a housing 3 having an inner compartment 5 and an inner surface, wherein the housing 3 usually has an open top, a base wall 13 having an aperture 15, a back wall 17, a front wall 19, and side walls. The housing 3 is usually constructed of plastic, wood or equivalent material. The housing components cooperate to hold or encase the remaining elements of the subject invention. Other equivalent configurations are contemplated to be within the realm of this disclosure and include fabrication designs that incorporate combined or additional similar elements.

The housing 3 attaches to the shaft S of the golf club GC, preferably proximate to the club head H, hosel, or neck, wherein the back wall 17 fits substantially adjacent against the shaft S. Usually, the back wall 17 of the housing 3 comprises a groove or channel 25 wherein the shaft may align for improved attachment. Furthermore, preferably lining the groove or channel 25 is a non-skid material 27, such as foam rubber, to prevent movement or sliding of the housing 3 when attached to the shaft S. Means for reversibly attaching the housing 3 to the shaft S comprises, as shown in FIG. 1, at least one VELCRO strap 29, which allows for easy attachment and removal so that the apparatus 1 may be used with any golf club GC. It is understood, however, that equivalent reversible attachment means, such as clips, clamps, or other similar means of attachment, are contemplated as within the scope of this disclosure.

Within the inner compartment 5 of the housing 3, as shown in FIGS. *2a–2b*, is a power supply 31 having a first pole 33 and a second pole 35, wherein the power supply 31 is movably or, kinetically mounted such that the power supply 31 has a nonactuating position 37 and an actuating position 39. The power supply 31 is usually a battery, such as an ENERGIZER 303 or the like. The power supply 31 moves, preferably parallel to the shaft S of the golf club GC, from the nonactuating position 37 to the actuating position 39 when a predetermined centrifugal force of a golf swing is applied to the movably or kinetically mounted or kinetic power supply 31. When no or less than the predetermined centrifugal force is applied to the movably mounted or kinetic power supply 31, a primary resilient element 67 biases the power supply 31 in the nonactuating position 37. Also within the inner compartment 5 is a signaling device 41 having a first lead 43 and a second lead 45, wherein the signaling device 41 emits a signal when the power supply 31, transported or moved by the predetermined centrifugal force, assumes the actuating position 39. Usually, at a minimum, the signaling device 41 is an auditory alarm, such as a piezobuzzer; although, other signaling devices are contemplated, such as a visual alarm. The signaling device 41 usually mounts, although not exclusively, in the open top of the housing 3. A circuitry means, preferably being electrically conductive, usually comprises a primary wire 47 and a secondary wire 53, each having a first end 49, 55 and a second end 51, 57. Generally, although not exclusively, the primary wire first end 49 contacts or attaches to the signaling device first lead 43 and the primary wire second end 51 contacts or touches the power supply first pole 33 preferably when the power supply 31 is located in the actuating position 39, but the primary wire second end 51 preferably does not contact or touch the power supply first pole 33 when the power supply 31 is in the nonactuating position 37; additionally, the secondary wire first end 55 preferably continuously contacts or attaches to the signaling device second lead 45 and the secondary wire second end 57 preferably continuously contacts or attaches to the power supply second pole 35. The disclosed means for completing the electrical circuit is not exclusive, while alternative circuitry means are contemplated.

Adjustable means are provided to manipulate the centrifugal force required to shift the power supply 31 from the nonactuating position 37 to the actuating position 39. Preferably, although not exclusively, the adjustable means comprises a movable base plate 59, with an internal threaded aperture 76, an adjustment rod 61, preferably threaded and fitted within the internal threaded aperture of the base plate 59. The adjustment rod 61 has a first end 63 and a second end 65 and an associated knob 79 at the second end 65. Also provided are primary 67 and secondary 73 resilient elements, usually each is a spring or the like, each having a first end 69, 75 and a second end 71, 77, respectively. In this embodiment, the movable base plate 59 is positioned within the inner compartment 5 above the base wall 13 and beneath the power supply 31. The primary resilient element first end 69 attaches to the base plate 59 and the primary resilient element second end 71 touches the power supply 31, wherein the primary resilient element 67 biases the movable power source 31 in the nonactuating position 37. Preferably, threaded into the threaded aperture 76 of the base plate 59 is the adjustment rod first end 63. The adjustment rod 61 passes through the aperture 15 of the base wall 13. Preferably, a knob 79 or the like attaches to the adjustment rod second end 65 and contacts the outside surface of the base wall 13. The adjustment rod 61 usually rotates, preferably in a clockwise and counter-clockwise direction, wherein rotation of the rod 61 moves the base plate 59, thereby increasing or decreasing the bias or resistance applied on the power supply 31 by the primary resilient element 67. By increasing or decreasing the resistance on the power supply 31, generally, a faster or slower golf swing, respectively, is required to move or transport the power supply 31 to the actuated position 39.

Figure 4:
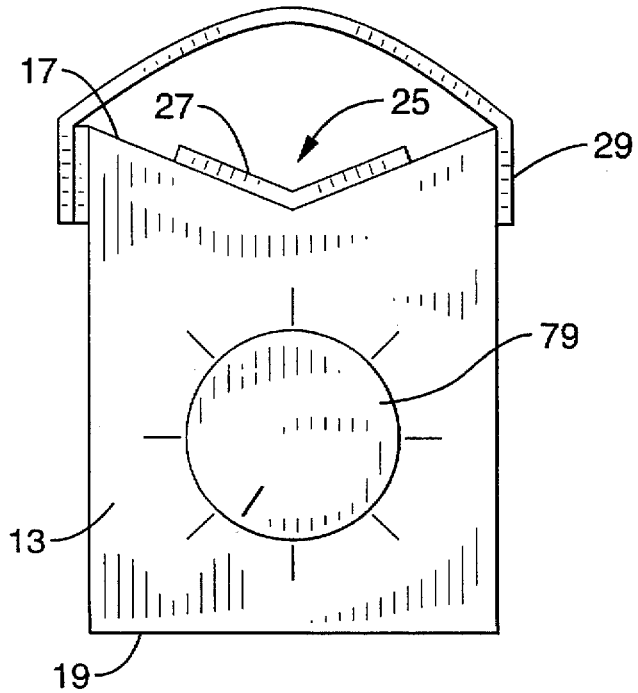
FIG. 4 is an enlarged bottom side view of the apparatus.

Preferably, the secondary resilient element 73 is situated between the base plate 59 and the base wall 13, wherein the secondary resilient element first end 75 meets the base plate 59 and the secondary resilient element second end 77 meets the base wall 13 so as to maintain the adjustment rod 61 at a predetermined position by exerting pressure between the inner surface of the base wall 13 and the base plate 59. Typically, the adjustment means may be calibrated, as shown in FIG. 4, to allow for consistent adjustment of the predetermined centrifugal force required for the individual user or the individual golf club utilized.

Specifically, another embodiment (shown specifically in FIGS. 5 and 6) of the subject invention or apparatus 101 comprises a housing 100 which, in its simplest form could be a rectangular box with a hinged lid 105. Other configurations for the housing are contemplated to be with the realm of this disclosure an include, but are not limited to: cylindrical; spherical and the like. The shape of the housing is riot critical as long as the housing has an interior to hold the signal generating means in a suitable and functional manner. Frequently, the housing 100 is fabricated from plastic or other lightweight material.

As in the initial embodiment, at least one VELCRO strap 110, which allows for easy attachment and removal so that the apparatus 100 may be used with any golf club and, as above again, it is understood that equivalent reversible attachment means, such as clips, clamps, or other similar means of attachment, are contemplated as within the scope of this disclosure.

Projecting from the housing 100 is the means for adjusting the amount of centrifugal force necessary to produce the signal. The threaded thumb screw 115 or equivalent is mounted through a threaded receiving aperture. the housing 100. The threaded region and usually the entire screw 115 is fabricated of electrically conductive material.

Figure 6:
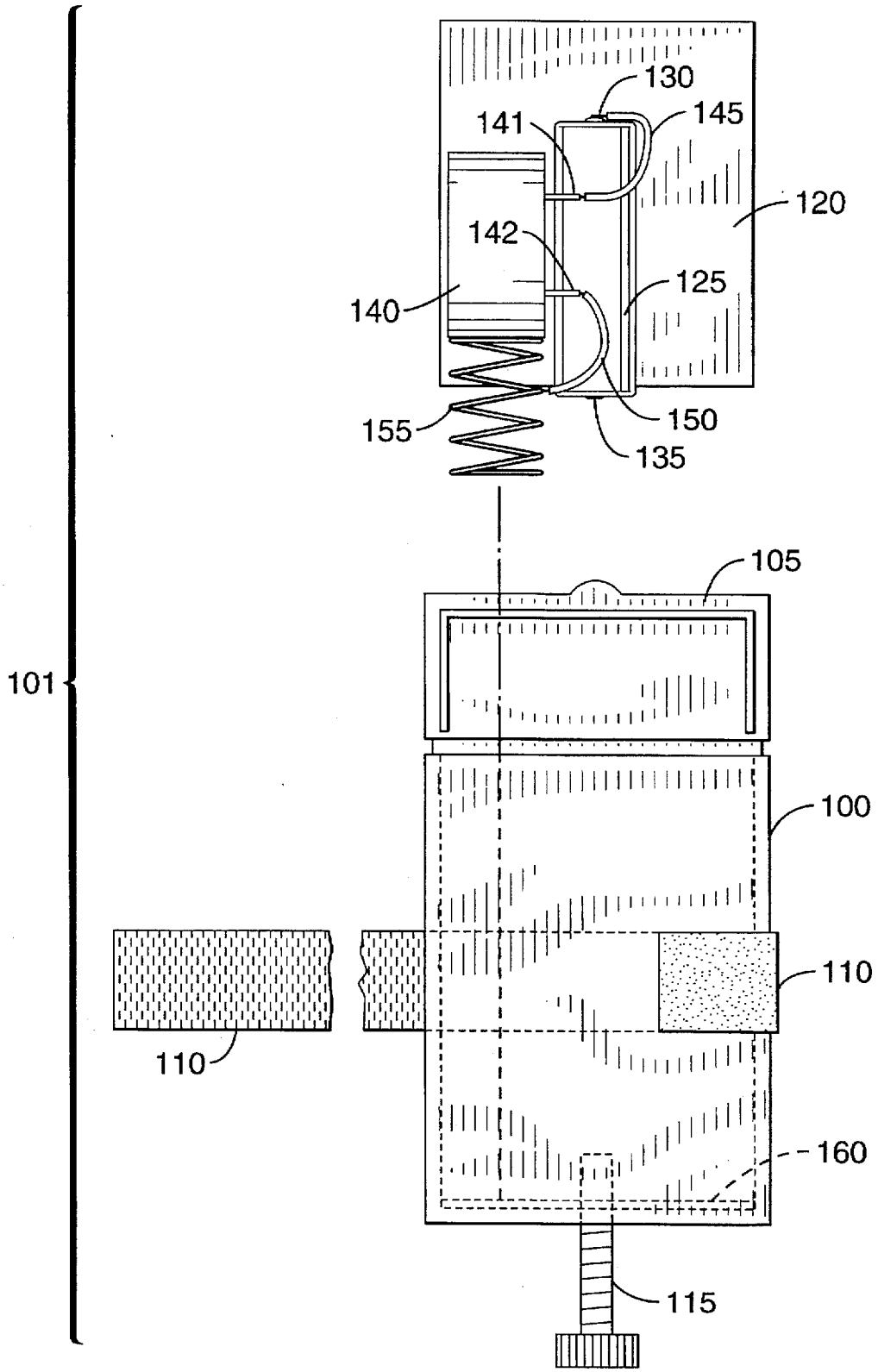
FIG. 6 is an exploded view of the additional embodiment depicted in FIG. 5.

FIG. 6 shows the sliding member 120 which slidable fits within the interior of the housing 100. Usually, the sliding panel or member 120 is generally planar or planar to slidably fit with the housing 100, but other appropriate geometries would be utilized for other shaped housings. The dimensions of the sliding member 120 are such that is able to slide in the direction of the applied centrifugal force yet remain relatively stable (to keep the signaling component in their correct orientation) in all other directions. FIG. 6 shows a rectangular, flat sliding member 120 that slidably fits within the surrounding rectangular housing 100.

Affixed to the sliding member 120 is a power source or means or usually a battery 125 that has first 130 and second 135 terminals. The battery 125 is secured to the sliding member 120 by conventional means and positioned to permit one terminal 135 to extend beyond the edge of the sliding panel 120.

Figure 5:
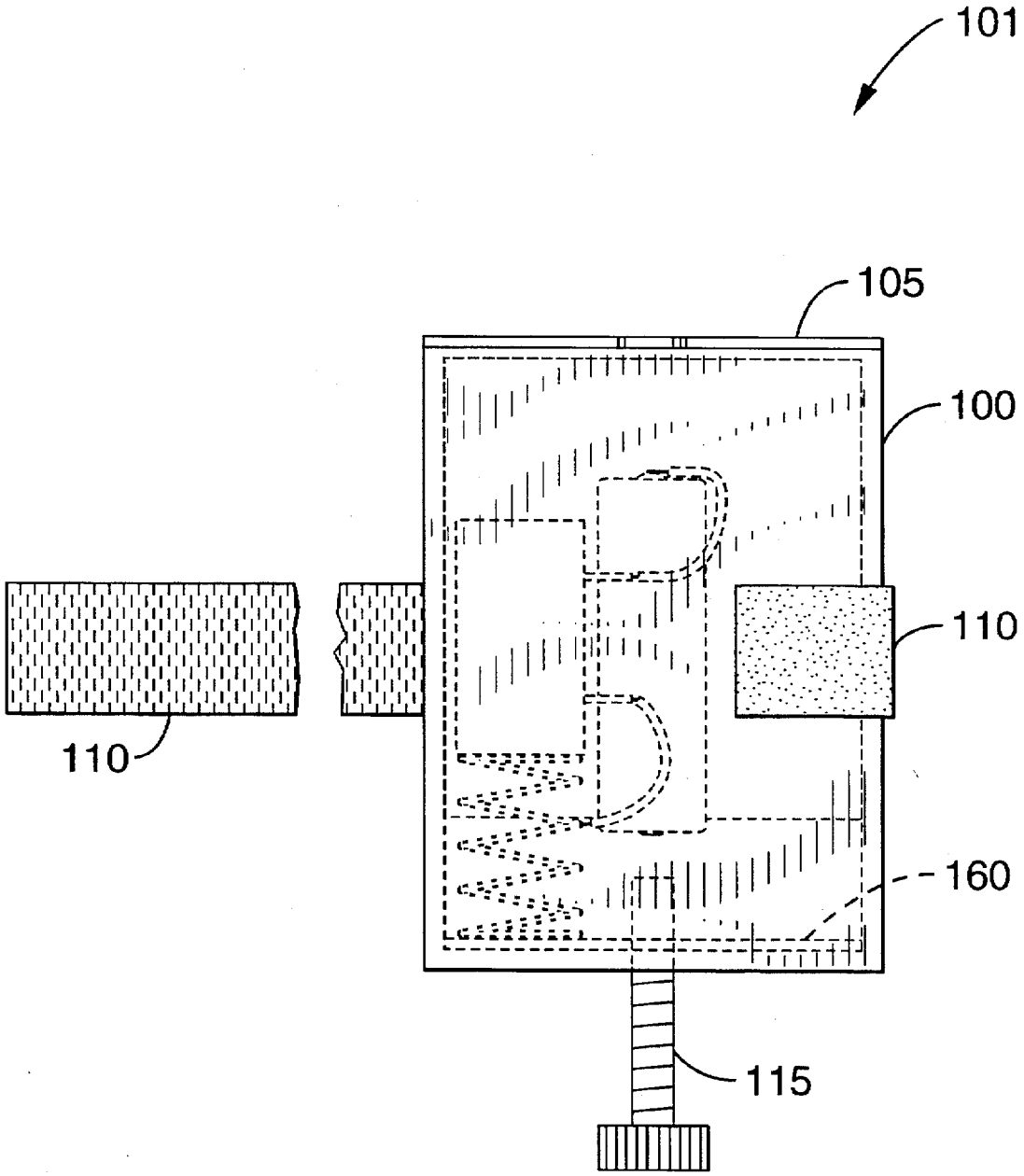
FIG. 5 is side view of an additional embodiment of the subject invention.

Also within the interior of the housing 100 is a signaling device 140 having a first lead or terminal 141 and a second lead or terminal 142, wherein the signaling device 140, as above, emits a signal when the power supply 125 and sliding member 120 are transported or slid by the predetermined centrifugal force and assumes the actuating position. As above, usually, at a minimum, the signaling device 140 is an auditory alarm, such as a piezobuzzer; although, other signaling devices are contemplated, such as a visual alarm. The signaling device 140 may be mounted to the sliding member (as seen in FIGS. 5 and 6) or positioned in other equivalent locations within the housing 100. Connectors or wires 145 and 150 connect the signaling device 140 to one terminal 130 of the battery 125 and a biasing means or spring 155, respectively.

The biasing means or equivalent spring 155 serves to hold the sliding member 120 at a distance above the bottom of the interior of the housing 100 until sufficient centrifugal force is exerted to compress the spring 155, thereby activating the signal by completing the circuit (between elements 115 and 135). In FIGS. 5 and 6 the spring 155 is shown fastened to the signal device 140, which is, in turn, connected to the sliding member 120, but other locations for the spring are contemplated and would be suitable if the sliding member 120 is biased sufficiently and include a direct attachment to the sliding member 120.

In the bottom of the interior of the housing 100 is an electrically conductive base plate 160. The plate 160 is usually secured to the bottom by standard means. The threaded adjustment screw 115 passes through this plate 160 and makes electrical contact with it.

During use, while attached to a golf club, the sliding member 120, with its attached battery 125, slide toward the bottom of the interior of the housing 100. The spring 155 resists the sliding member 120, but once sufficient centrifugal force is created the bottom terminal 135 of the battery 125 contacts the end of the screw 115 and completes the signaling circuit to produce the selected signal, usually a sound. When the swing slows the spring 155 forces the circuit to open and the signal stops.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A swing training apparatus for sensing centrifugal force created from a swing of a handheld sport implement and producing a signal for a predetermined level of centrifugal force, the apparatus comprising:

a) a housing;

b) a power source;

c) a sliding member affixed to said power source and slidably positioned within said housing;

d) biasing means for holding said sliding member in a signal nonactuating position within said housing;

e) signal means coupled to said sliding member, wherein the centrifugal force created by the swinging sport implement slides said sliding member within said housing thereby actuating said signal means to produce a signal.

2. A swing training apparatus for a handheld sport implement having a shaft and a head, wherein the apparatus is actuated by centrifugal force from swinging the sport implement, the apparatus comprises:

a) a housing;

b) a sliding member slidably positioned within said housing; and c) electronic means responsive to centrifugal force from swinging the sport implement, said electronic means comprising:

i) power means mounted within said housing and to said sliding member, wherein said power means has an actuating position and a nonactuating position, wherein said power means moves from said nonactuating position to said actuation position in response to a predetermined centrifugal force;

ii) signaling means electrically coupled to said power means, wherein said signaling means emits a signal when said power means assumes said actuating position; and iii) circuitry means for said electrical coupling of said power means and said signaling means;

d) biasing means secured to said power means for maintaining said power means in said nonactuating position when said predetermined centrifugal force is not sufficient to move said power means into said actuating position; and e) means for reversible attachment of said housing of the apparatus to the shaft of the sport implement proximate to the head.

3. A sport implement swing training apparatus according to claim 2, further comprising adjustable force means that regulates the amount of centrifugal force necessary to produce a signal.

4. A sport implement swing training apparatus according to claim 3, wherein said adjustable force means comprises:

a) an electrically conductive screw adjustable mounted in said housing and b) an electrically conductive base plate contacting said electrically conductive screw.

5. A sport implement swing training apparatus according to claim 2, wherein said sliding member comprises a panel sized to fit and to slide within said housing.

6. A sport implement swing training apparatus according to claim 2, wherein said power means comprises a battery secured to said sliding member.

7. A golf swing training apparatus, actuated by sufficient centrifugal force of a golf swing, for attachment to a golf club having a shaft and a club head, the apparatus comprises:

a) a housing having an interior compartment;

b) a sliding panel slidably positioned within said interior compartment of said housing;

c) a battery having first and second terminals and secured to said sliding panel;

d) a signaling means having first and second terminals and wired by said first signaling means terminal to said first battery terminal;

e) an electrically conductive screw adjustable mounted in said housing;

f) an electrically conductive base plate contacting said electrically conductive screw; and g) an electrically conductive spring wired to said signaling means second terminal and contacting said electrically conductive base plate, wherein said spring maintains a centrifugal force sensitive separation between said second battery terminal and said electrically conductive screw, whereby when said golf swing produces the sufficient centrifugal force said secondly battery terminal contacts said electrically conductive screw thereby forming a complete circuit and activating said signalling means.

* * * * *